US008205965B2

(12) United States Patent
Scheffelin et al.

(10) Patent No.: US 8,205,965 B2
(45) Date of Patent: Jun. 26, 2012

(54) PRINT BAR STRUCTURE

(75) Inventors: Joseph E Scheffelin, Poway, CA (US); Dan Dowell, Albany, OR (US); Joe Elliot, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 196 days.

(21) Appl. No.: 12/839,811

(22) Filed: Jul. 20, 2010

(65) Prior Publication Data

US 2012/0019593 A1 Jan. 26, 2012

(51) Int. Cl.
*B41J 2/16* (2006.01)

(52) U.S. Cl. ..... 347/49; 347/42

(58) Field of Classification Search ..... 347/13, 347/42, 49

See application file for complete search history.

(56) References Cited

U.S. PATENT DOCUMENTS

| | | | | |
|---|---|---|---|---|
| 6,350,013 | B1 | 2/2002 | Scheffelin et al. | |
| 6,428,141 | B1 * | 8/2002 | Mc Elfresh et al. | 347/40 |
| 7,270,401 | B2 * | 9/2007 | Silverbrook et al. | 347/59 |
| 7,946,684 | B2 * | 5/2011 | Drury et al. | 347/49 |
| 2005/0035990 | A1 | 2/2005 | Wotton et al. | |
| 2005/0093899 | A1 | 5/2005 | Kawamura et al. | |
| 2007/0070096 | A1 | 3/2007 | Ha et al. | |
| 2007/0126797 | A1 | 6/2007 | Hibbard et al. | |

* cited by examiner

*Primary Examiner* — Lamson Nguyen

(57) ABSTRACT

In one embodiment, a print bar structure includes a single part having: a datum; an exterior printhead attach surface a predetermined distance from the datum for attaching multiple printheads to the print bar structure; an interior bay for holding a liquid distribution part; and multiple openings from the interior bay to the exterior printhead attach surface.

15 Claims, 12 Drawing Sheets

PRINT BAR STRUCTURE

BACKGROUND

In some inkjet printers, a media wide arrangement of stationary printheads is used to print on paper or other print media moving past the array. In one type of print bar for media wide inkjet printers, a series of individual printheads are mounted to a rigid body that extends across the width of the media path. One of the challenges in making these types of print bars is accurately affixing each printhead to the body at the correct height to maintain the desired spacing between the printheads and the print media during printing.

DRAWINGS

FIG. 1 is a block diagram illustrating one example of an inkjet printer in which embodiments of the present disclosure may be implemented.

FIGS. 2 and 3 are elevation views of one arrangement for a print bar in which the ink flow distribution parts are stacked on the face of the body of the print bar. FIG. 2 is a diagrammatic, partial section side view of the stack with the parts exploded apart from one another. FIG. 3 is an end view showing the assembled stack.

FIGS. 4 and 5 are elevation views of another arrangement for a print bar, according to an embodiment of the disclosure, in which the ink flow distribution parts are stacked inside the body of the print bar. FIG. 4 is a diagrammatic, partial section side view of the stack with the parts exploded apart from one another. FIG. 5 is an end view showing the assembled stack.

The same part numbers are used to designate the same or similar parts throughout the figures.

DESCRIPTION

Embodiments of the new print bar structure were developed in an effort to help ensure that the printheads are positioned at the correct height on the print bar when using lower cost, molded plastic parts. The embodiments shown in the figures and described below are non-limiting, example embodiments. Other embodiments are possible and nothing in the following description should be construed to limit the scope of the disclosure, which is defined in the Claims that follow this Description.

Although embodiments of the new print bar are not necessarily limited to dispensing ink or other liquids, and may be used for dispensing other fluids, inkjet printheads generally are not practical for dispensing fluids composed primarily of gas(es). Thus, "liquid" as used in this document means a fluid not composed primarily of a gas or gases. A "printhead" as used in this document refers to that part of an inkjet printer or other type of inkjet drop dispenser that expels drops of liquid from one or more openings, including what is commonly referred to as a printhead die, a printhead die assembly and/or a printhead die carrier assembly. "Printhead" and "print bar" are not limited to printing with ink but also include inkjet type dispensing of other liquids and/or for uses other than printing.

Figure 1:
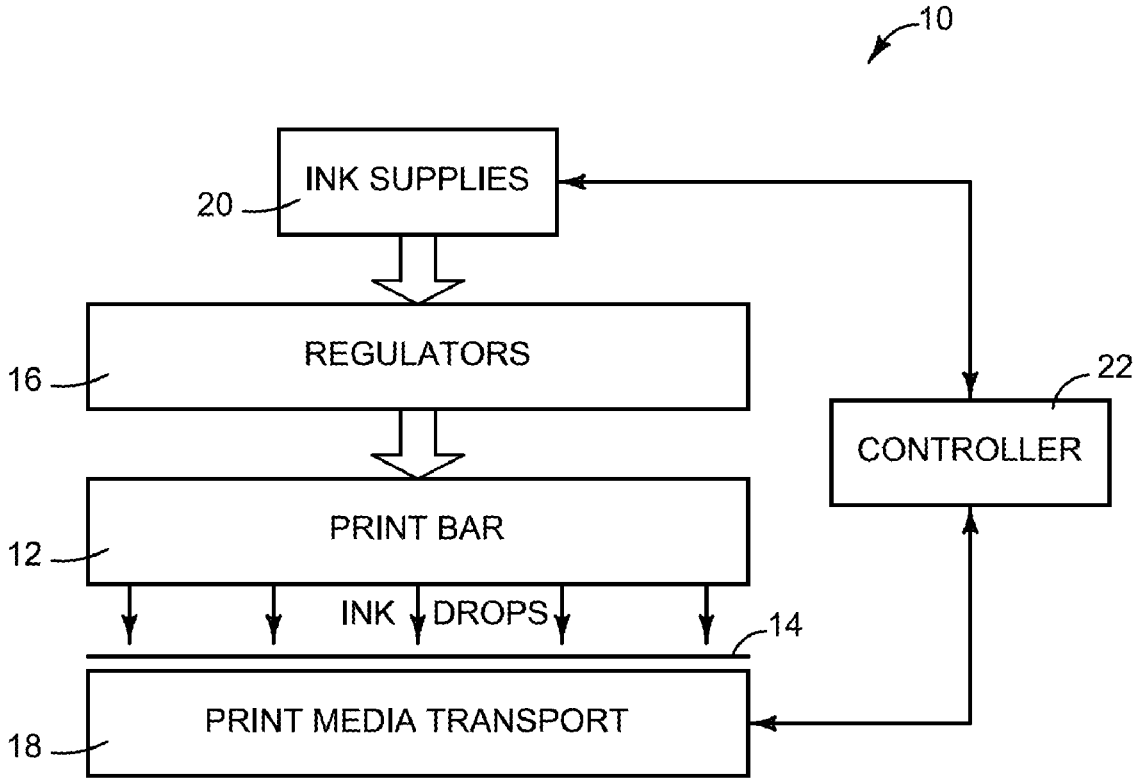

FIG. 1 is a block diagram illustrating one example of an inkjet printer in which embodiments of the disclosure may be implemented. Referring to FIG. 1, an inkjet printer 10 includes a print bar 12 spanning the width of a print media 14. Printer 10 also includes flow regulators 16 associated with print bar 12, a media transport mechanism 18, ink supplies 20, and an electronic printer controller 22. Print bar 12 in FIG. 1 includes an arrangement of multiple printheads for ejecting drops of ink on to a sheet or continuous web of paper or other print media 14. A typical thermal inkjet printhead, for example, includes an orifice plate arrayed with ink ejection orifices and firing resistors formed on an integrated circuit chip positioned behind the ink ejection orifices. Each printhead is electrically connected to printer controller 22, typically through a flexible circuit tape holding multiple electrical conductors. Each printhead is fluidically connected to one or more ink supplies 20 through a typically complex ink flow path in print bar 12 and through flow regulators 16. In operation, printer controller 22 selectively energizes ink ejector elements in a printhead, or group of printheads, in the appropriate sequence to eject ink on to media 14 in a pattern corresponding to the desired printed image. Controller 22 in FIG. 1 represents generally the programming, processor(s) and associated memories, and the electronic circuitry and components needed to control the operative elements of a printer 10.

Figure 2:
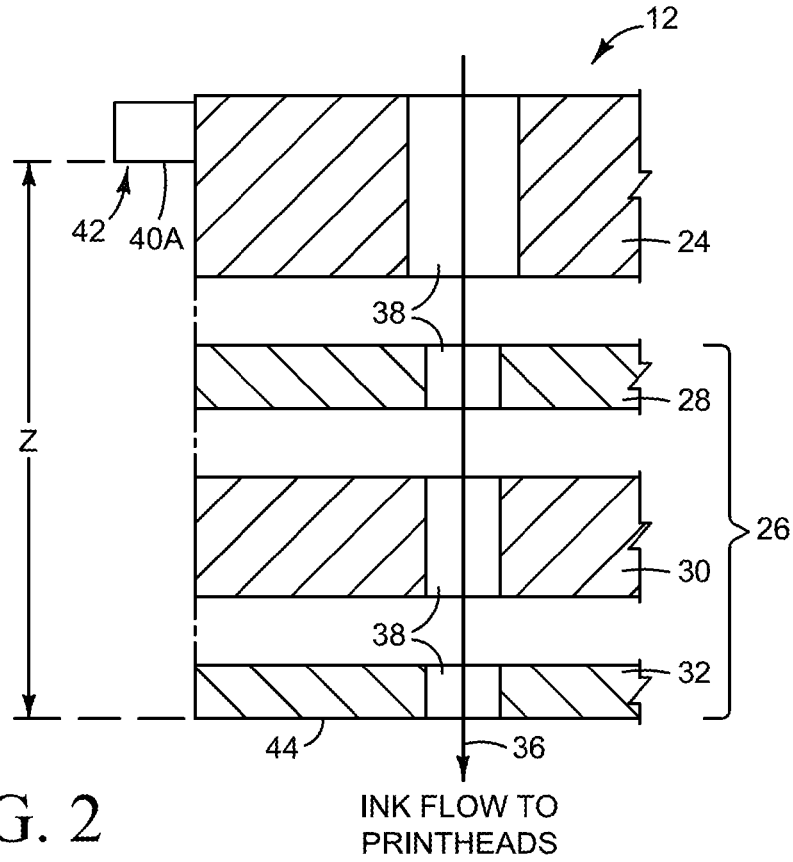
Figure 3:
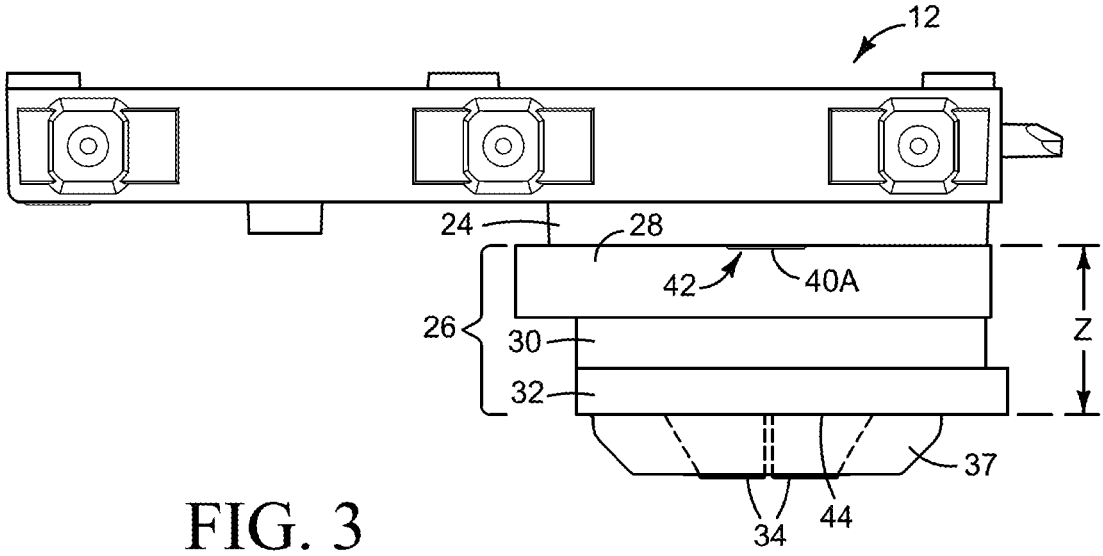

FIGS. 2 and 3 are elevation views of one arrangement for a print bar in which the ink flow distribution parts are stacked on the face of the body of the print bar. FIG. 2 is a diagrammatic, partial section side view of the stack with the parts exploded apart from one another. FIG. 3 is an end view showing the assembled stack. The arrangement shown in FIGS. 2 and 3 has disadvantages overcome by embodiments of the present disclosure, which are described below with reference to FIGS. 4-16. The arrangement shown in FIGS. 2 and 3 is presented to illustrate some of the problems encountered in the design of PWA (page wide array) and other wider array print bars and is not admitted to be prior art.

Referring to FIGS. 2 and 3, a print bar 12 includes a body 24 supporting a stack 26 of ink distribution plates 28, 30 and 32 affixed to the outside of body 24. Ink flows to printheads 34 from the ink supplies 20 and flow regulators 16 (FIG. 1) along a flow path 36 through a typically complex series of openings and conduits in body 24 and plates 28, 30 and 32, indicated generally by simplified openings 38 in FIG. 2. (Printheads 34 are not shown in FIG. 2.) Presently, it is very difficult to cost effectively fabricate the complex ink flow path in a single part and, therefore, the flow path to printheads 34 is formed in a series of multiple ink flow parts glued or otherwise affixed to one another. The individual ink flow parts are often referred to as "plates" and "manifolds". In the arrangement shown in FIGS. 2 and 3, for example, the ink flow parts include body 24, a mid-plate 28, a manifold 30 and a bottom plate 32. A shroud 37 extends along the bottom of print bar 12, covering exposed portions of bottom plate 32 and printheads 34 while leaving the face of each printhead 34 exposed for jetting ink.

A pair of reference surfaces 40A and 40B, one on each end of the length of body 24 for example, form a datum 42 used to help accurately affix each printhead 34 at the correct distance Z and thus help to maintain the desired spacing between printheads 34 and the print media during printing. Only reference surface 40A of datum 42 is visible in the truncated view of print bar 12 in FIG. 2 and in the end view of FIG. 3. In the arrangement shown in FIGS. 2 and 3, the surface 44 to which the printheads 34 are attached is on bottom plate 32, the third plate in stack 26. Hence, distance Z between printhead attach surface 44 and datum 42 depends on several parts—body 24, mid-plate 28, manifold 30 and bottom plate 32—and the process for assembling these parts. It is difficult to accurately assemble a stack 26 in the Z direction without excessive squish in the glue joints between parts 24/28, 28/30, 30/32 and 32/34 unless very precise, and thus expensive ground parts are used or unless the parts are placed to local standoffs (hard stop features on the parts).

Figure 4:
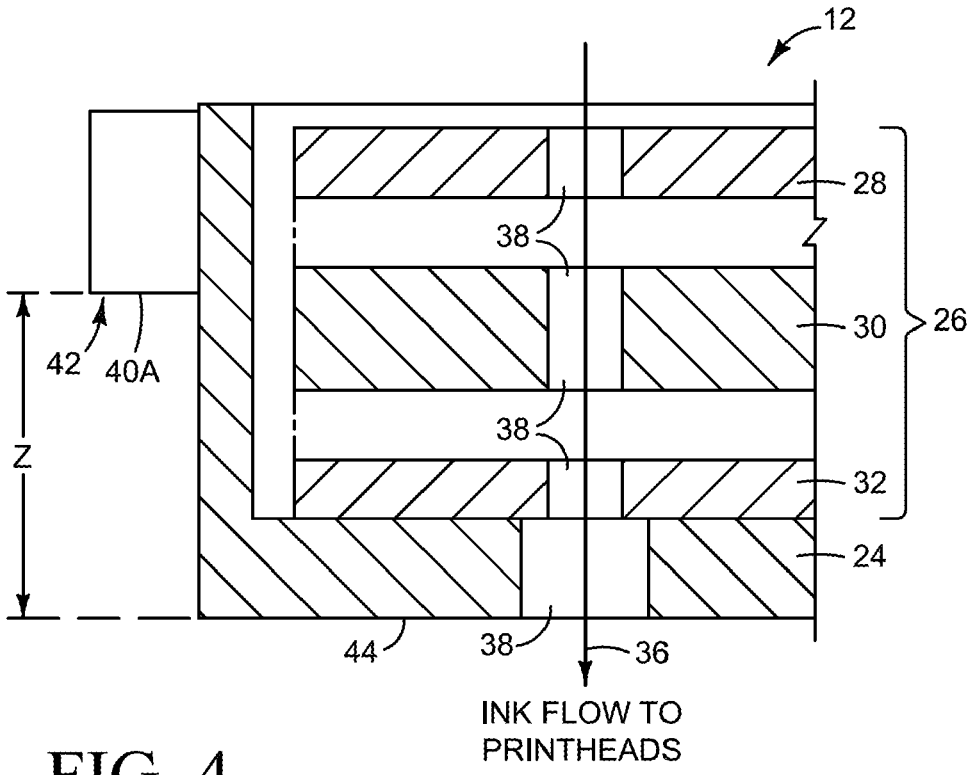
Figure 5:
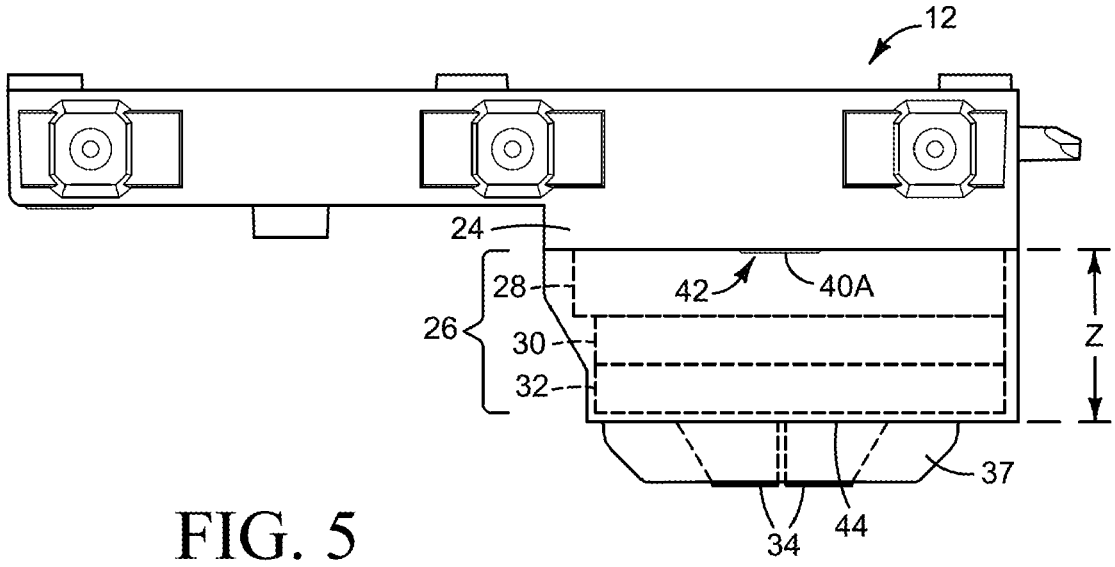

FIGS. 4 and 5 are elevation views of another arrangement for a print bar, according to one embodiment of the disclosure, in which the ink flow distribution parts are stacked inside the body of the print bar. FIG. 4 is a diagrammatic, partial section side view of the stack with the parts exploded apart from one another. FIG. 5 is an end view showing the assembled stack. The arrangement shown in FIGS. 4 and 5, in which the stack of ink distribution plates is disposed inside the body, was developed to help ensure that the printheads may be positioned at the correct Z distance on the print bar when using lower cost parts.

Referring to FIGS. 4 and 5, a print bar 12 includes a body 24 supporting a stack 26 of ink distribution plates 28, 30 and 32 within a bay 46 of body 24. Ink flows to the printheads 34 from the ink supplies 20 and flow regulators 16 (FIG. 1) along a flow path 36 through a typically complex series of openings and conduits in body 24 and plates 28, 30 and 32, indicated generally by simplified openings 38 in FIG. 4. (Printheads 34 are not shown in FIG. 4.) A shroud 37 extends along the bottom of print bar 12, covering exposed portions of body 24 and printheads 34 while leaving the face of each printhead 34 exposed for jetting ink.

A pair of reference surfaces 40A and 40B, one on each end of the length of body 24 for example, form a datum 42 used to help accurately affix each printhead 34 at the correct distance Z. Only reference surface 40A of datum 42 is visible in the truncated view of print bar 12 in FIG. 4 and in the end view of FIG. 5. In the arrangement shown in FIGS. 4 and 5, the surface 44 to which the printheads 34 are attached is on body 24. That is to say, datum 42 and printhead attach surface 44 are both formed on the same part—body 24. Hence, distance Z between printhead attach surface 44 and datum 42 depends on only a single part, rather than on several parts and the process for assembling the several parts. Although the "front load" arrangement shown in FIGS. 2-3 is narrower (there are no parts within a part), which may be an advantage in some printing environments, the "back load" arrangement shown in FIGS. 4-5 enables the use of less expensive parts while maintaining an accurate Z distance with lower tolerances/variations. And, the arrangement of FIGS. 4-5 has the added advantage of minimizing the risk that glue between the parts will be squished into the ink flow passages during assembly because the size of the gaps between body 24 and plates 28, 30 and 34 does not affect the Z distance.

Figure 6:
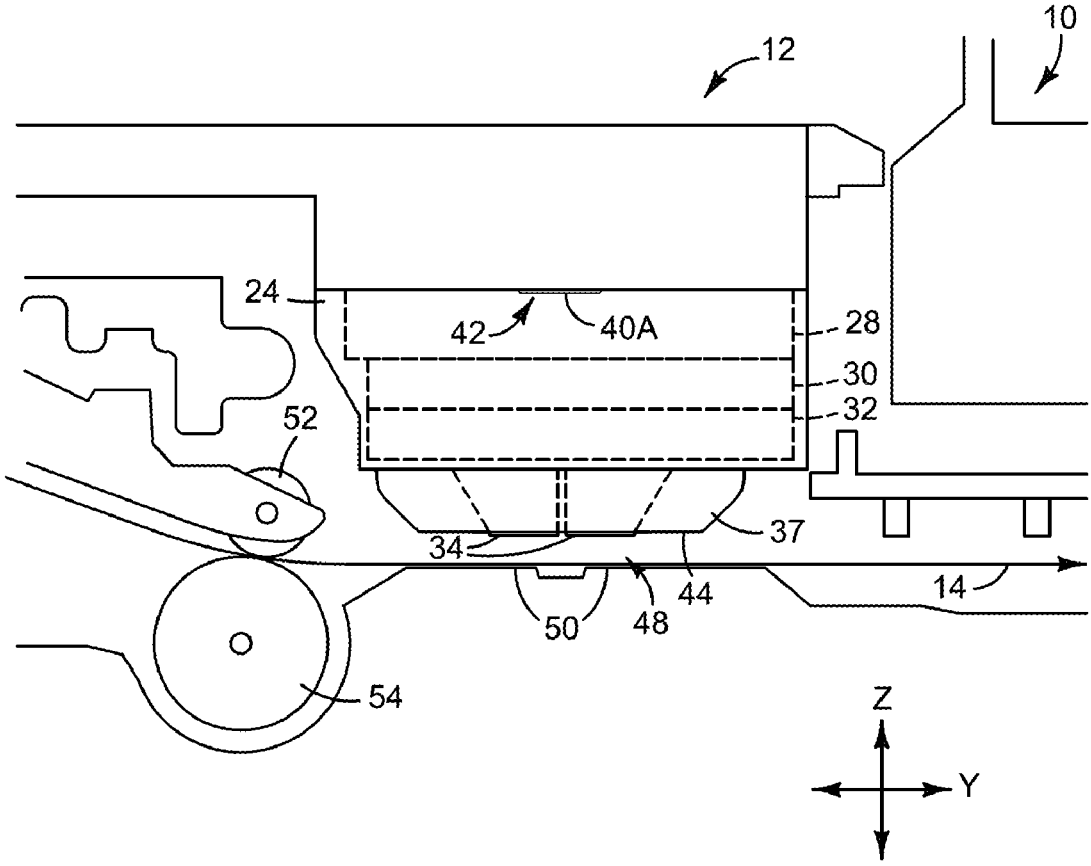
FIG. 6 is an end view showing the spacing between the printheads and the paper (or other print media) in a printer with the print bar embodiment of FIG. 5.
Figure 7:
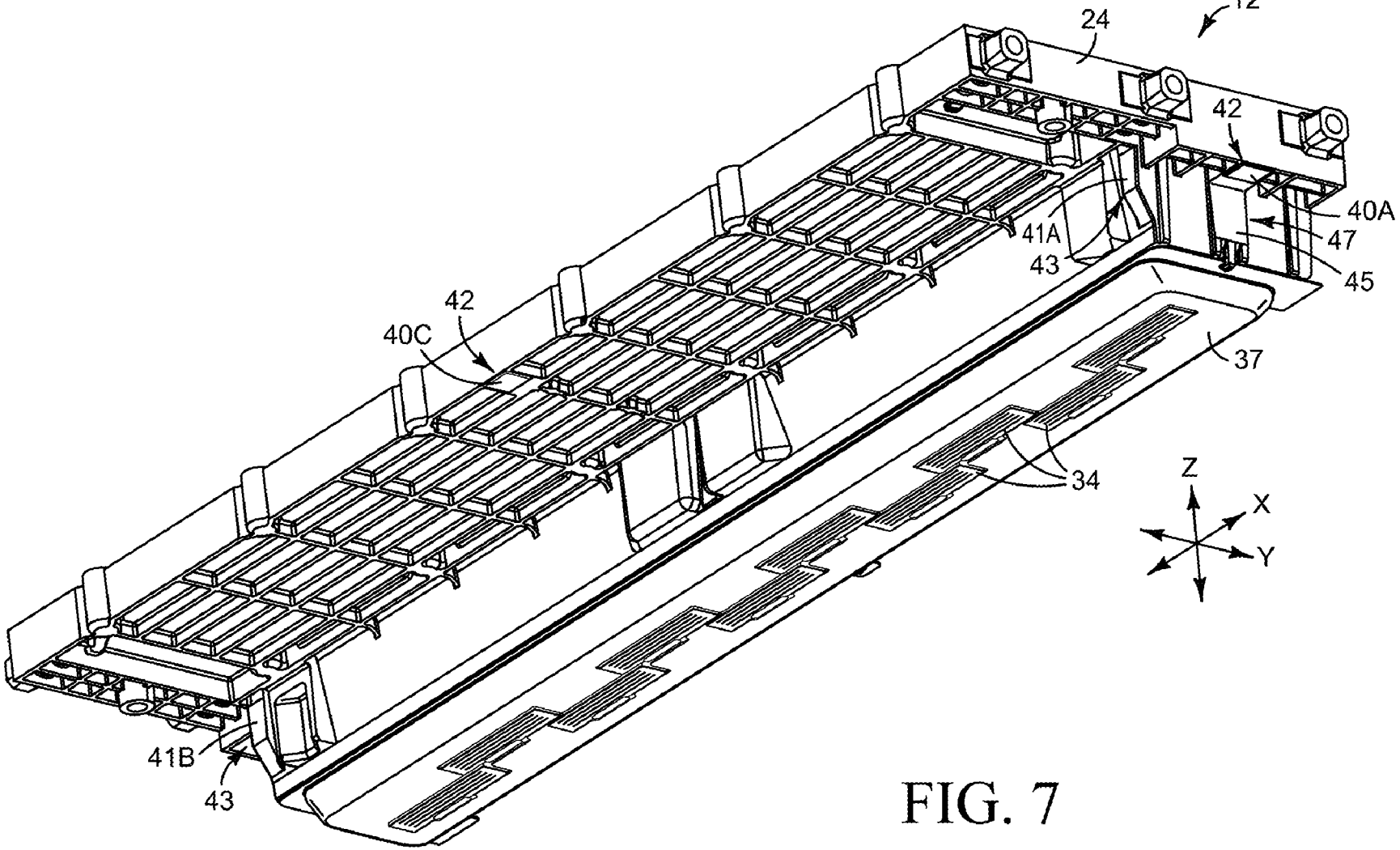
FIG. 7 is a perspective of a print bar, according to an embodiment of the disclosure, viewed looking toward the exposed printheads, which is typically the bottom of the print bar when the print bar is installed in a printer.

FIG. 6 is an end view showing the spacing between printheads 34 and print media 14 in a printer 10 with the print bar 12 embodiment shown in FIG. 5. Referring to FIG. 6, a sheet or web of print media 14 is moved through a print zone 48 between printheads 34 and a platen 50 at the urging of media transport rollers 52 and 54. Reference surfaces 40A and 40B (forming datum 42) abut mating surfaces on the printer chassis (not shown) to establish the correct Z direction spacing between printheads 34 and platen 50 when print bar 12 is installed in printer 10, and thus help establish the correct spacing between printheads 34 and print media 14 during printing. [Six points of contact may be used to correctly position and fully constrain print bar 12 in all six degrees of freedom of motion. In the embodiment shown in FIGS. 7-15, for example, three points of contact 40A, 40B and 40C form a primary Z datum 42 (FIGS. 7 and 11), two points contact 41A and 41B form a secondary Y datum 43 (FIG. 7), and one point of contact 45 forms a tertiary X datum 47 (FIG. 7). The three primary Z datum contact points 40A, 40B and 40C stop translation in the Z direction and rotation about the X and Y axes. The two secondary Y datum points 41A and 41B stop translation in the Y direction and rotation about the Z axis. The single tertiary X datum point 43 stops translation in the X direction.]

Figure 8:
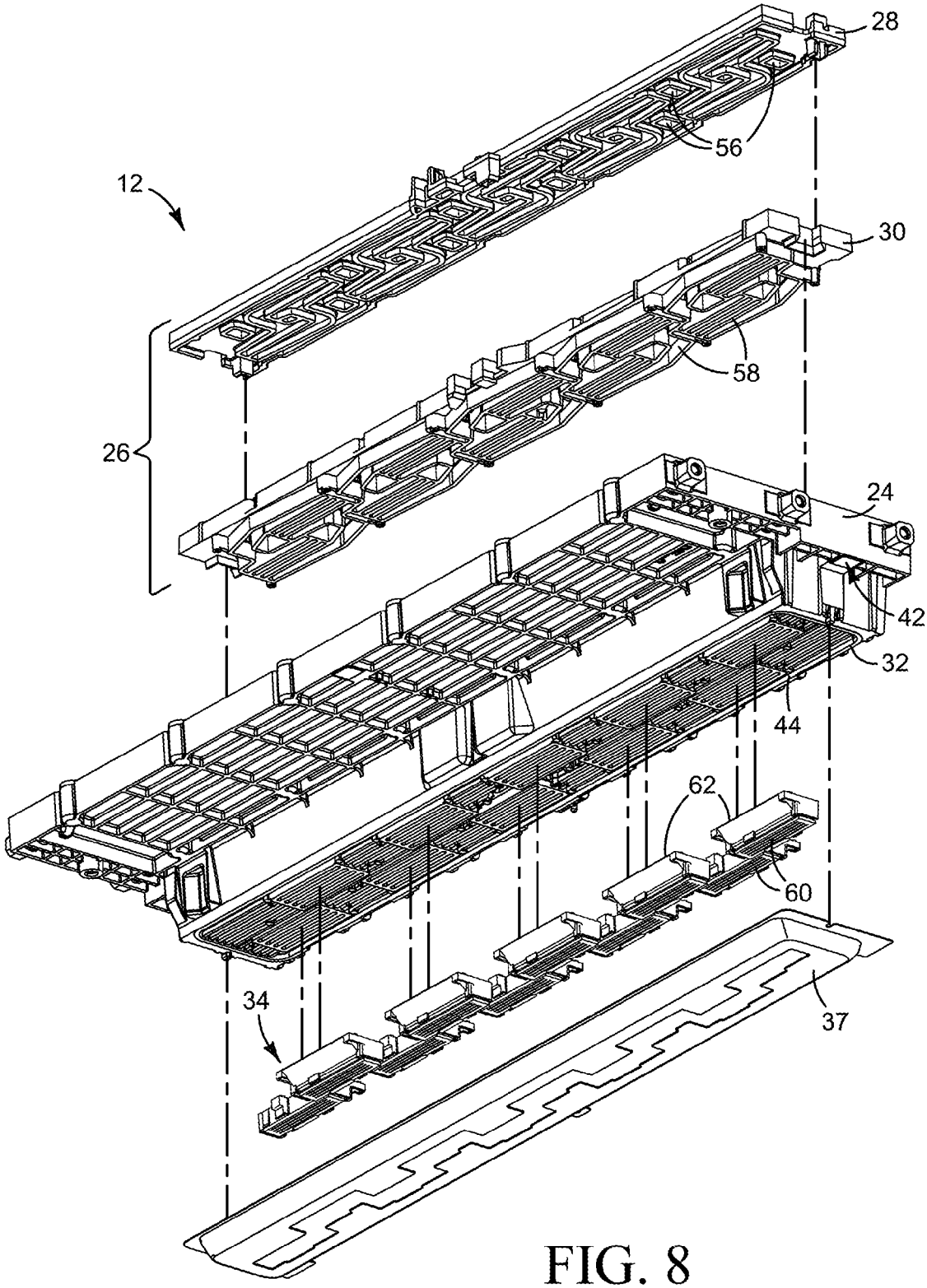
FIG. 8 is an exploded view of the print bar embodiment of FIG. 7.
Figure 9:
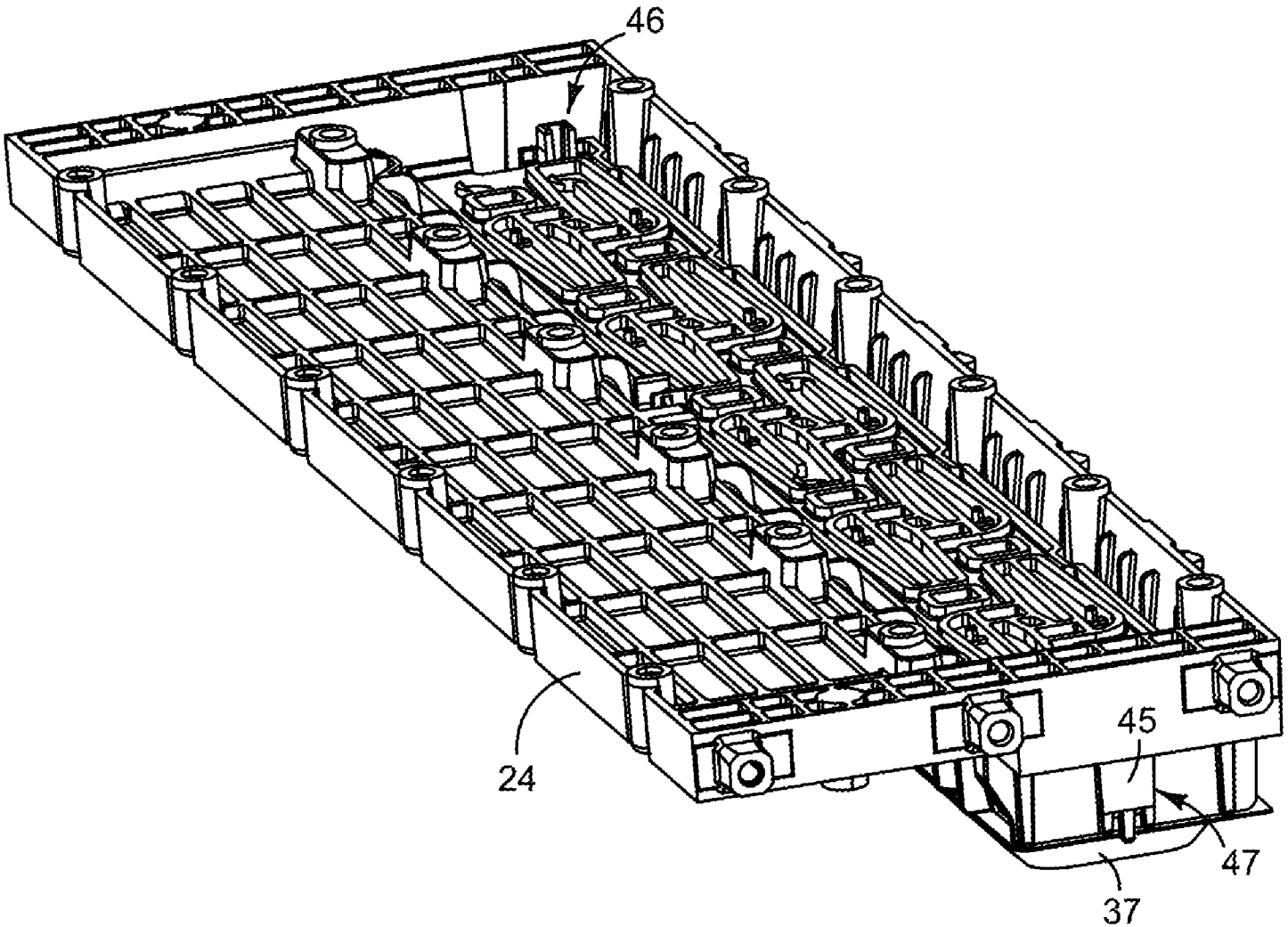
FIG. 9 is a perspective of the print bar embodiment shown in FIG. 7 viewed looking into the body of the print bar, which is typically the top of the print bar when the print bar is installed in a printer.
Figure 10:
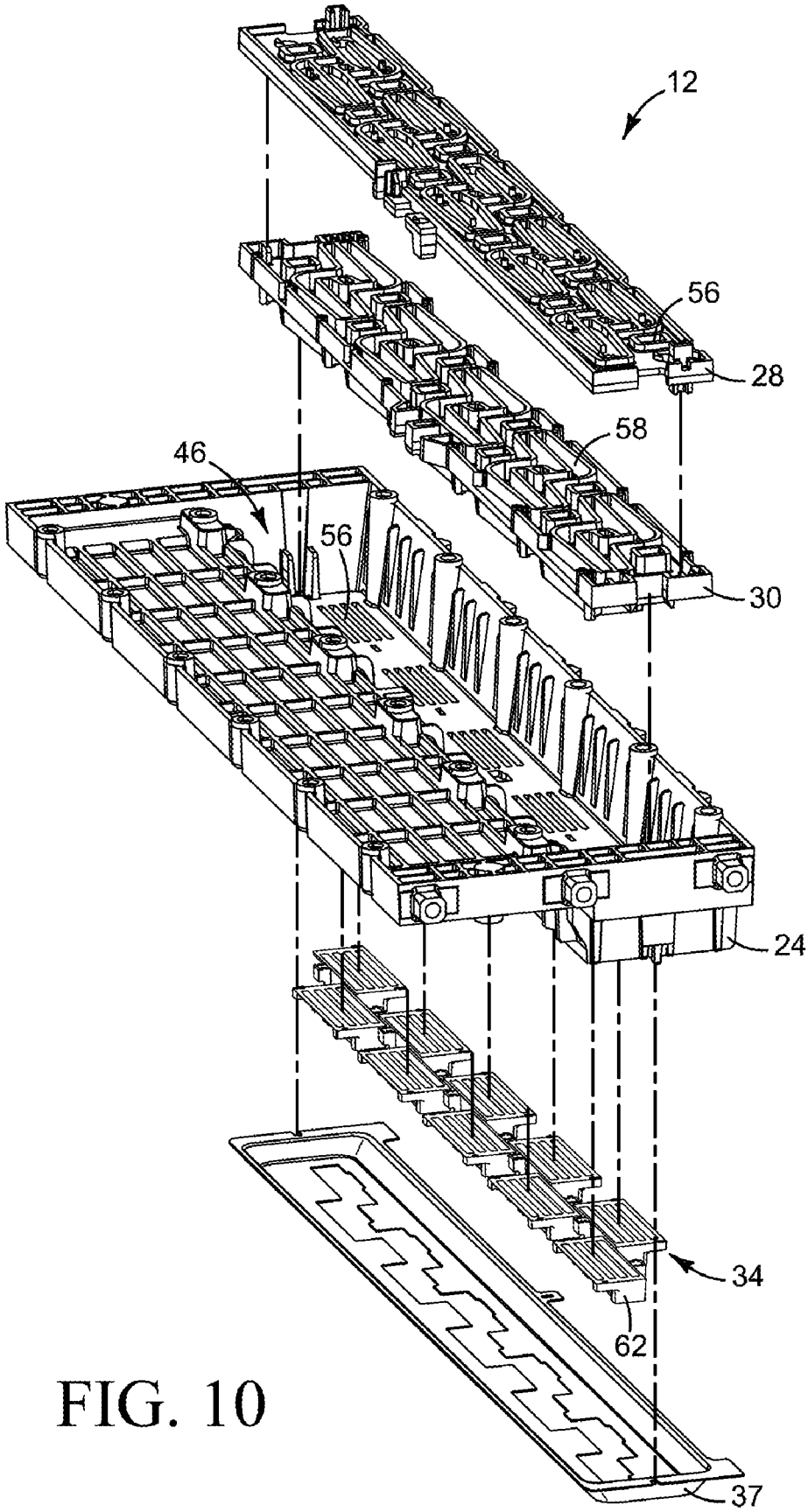
FIG. 10 is an exploded view of the print bar embodiment of FIG. 9.
Figure 11:
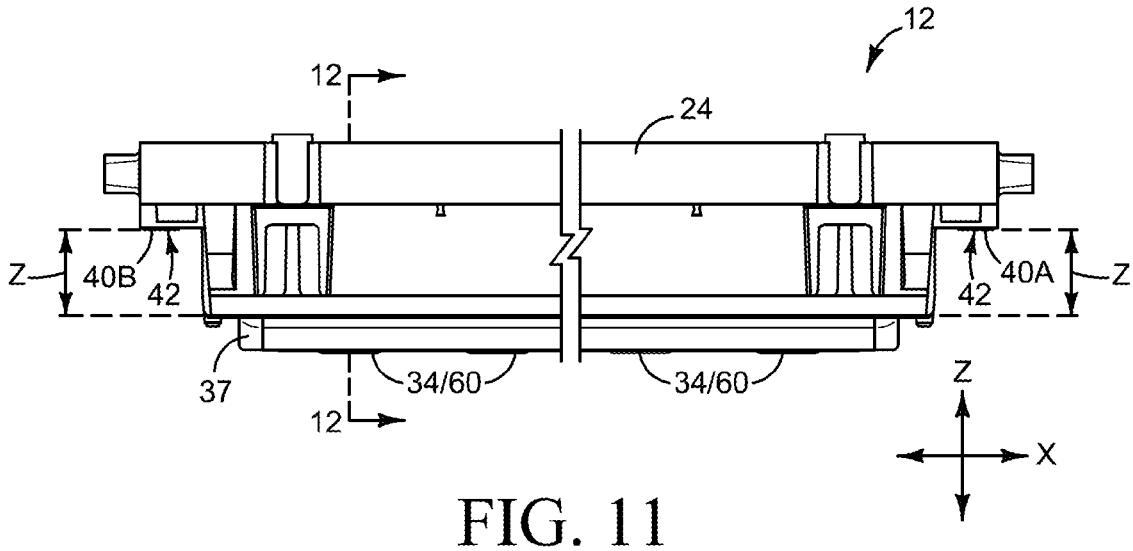
FIG. 11 is a side elevation view of the print bar embodiment of FIGS. 7-9.
Figure 12:
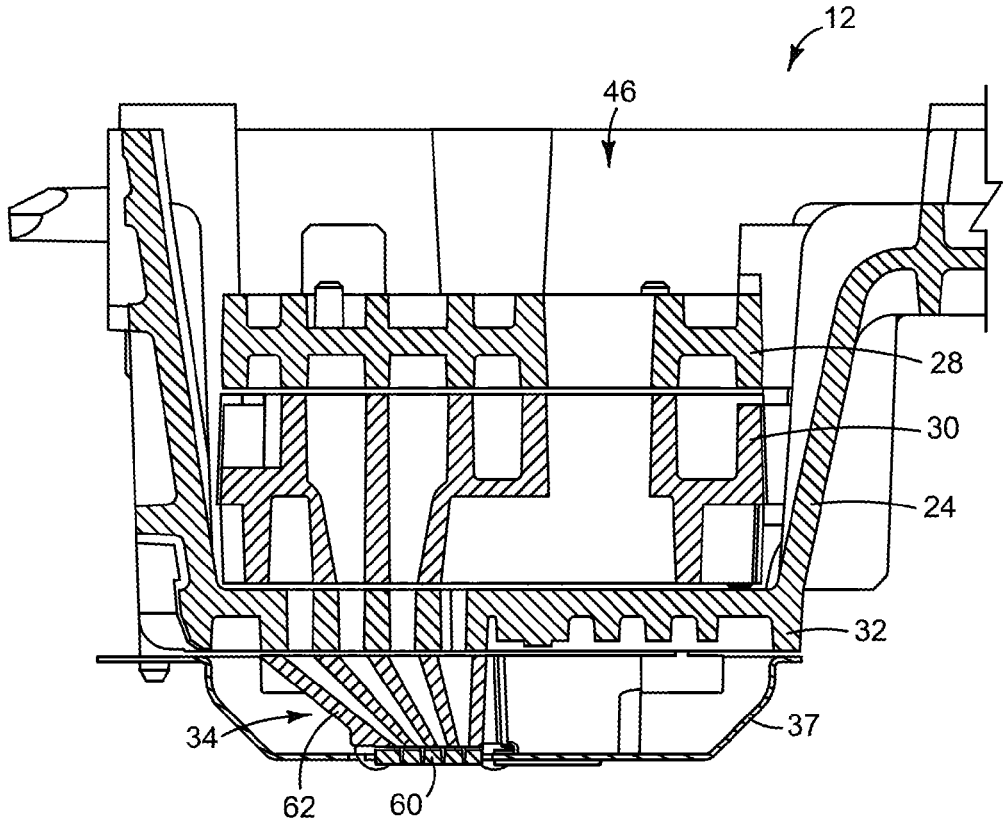
FIG. 12 is a partial section view taken along the line 12-12 in FIG. 11.
Figure 13:
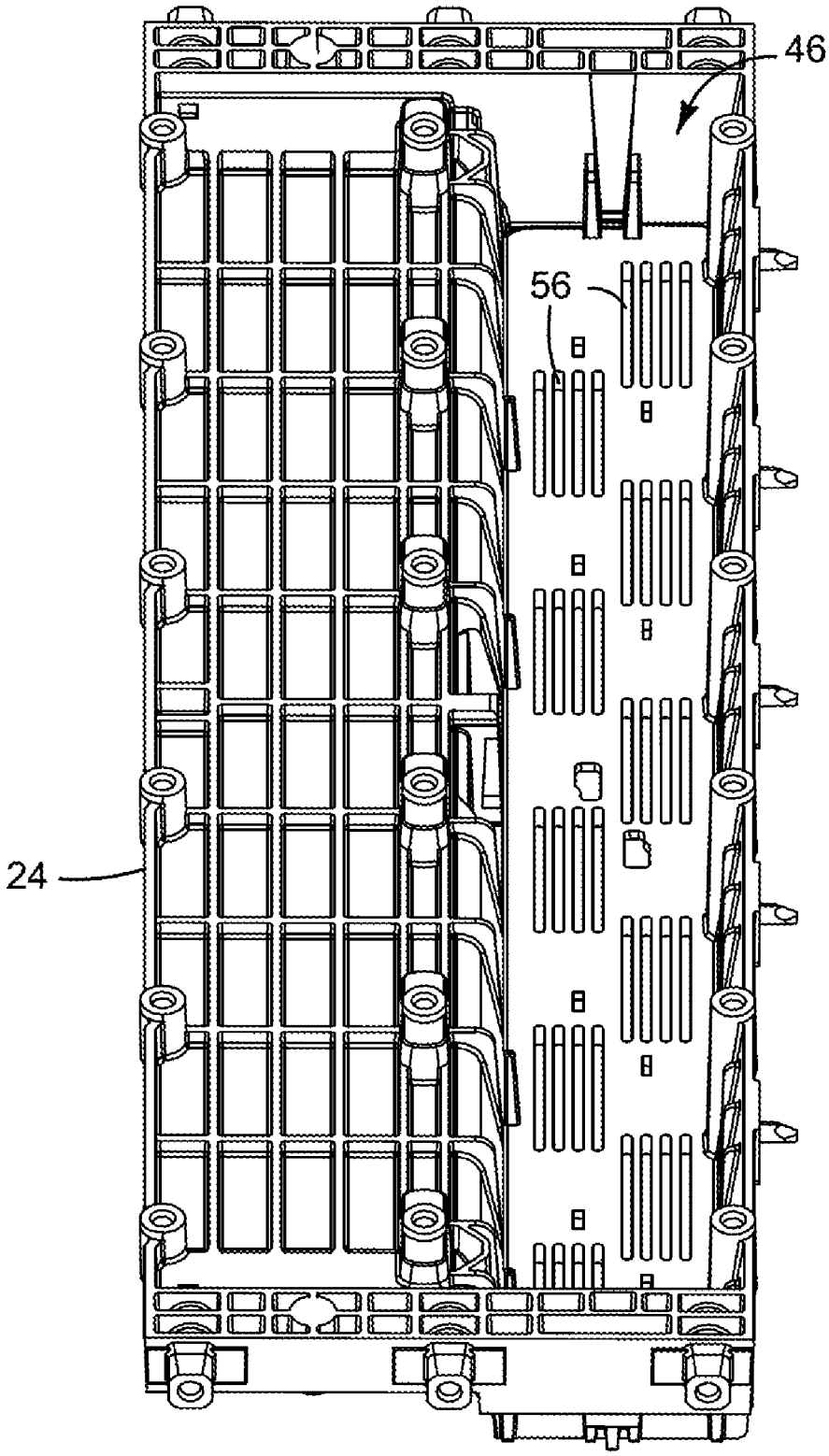
FIGS. 13 and 14 are detail perspectives viewed from the top and bottom, respectively, of the body of the print bar embodiment shown in FIGS. 7-9.
Figure 14:
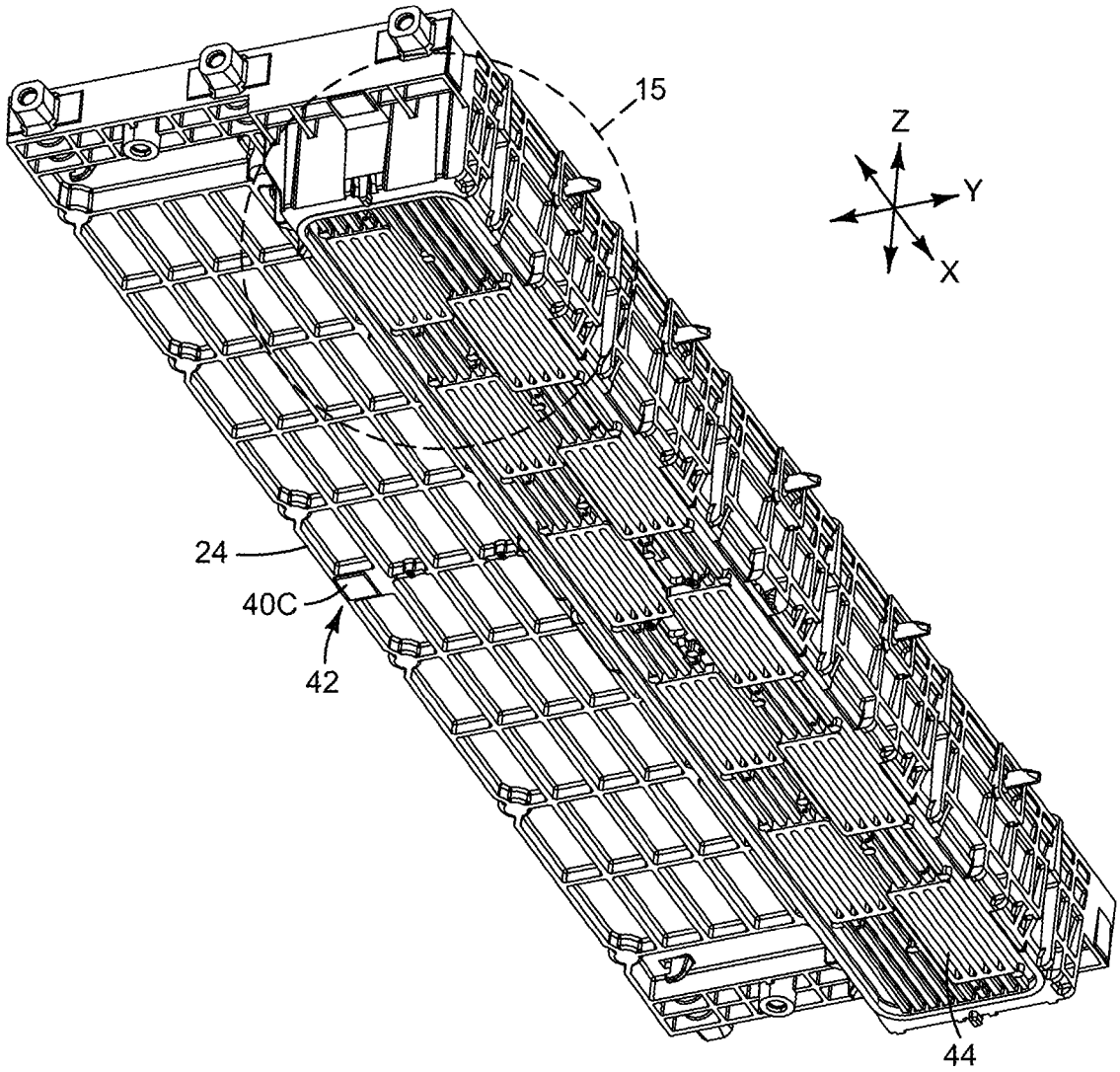
Figure 15:
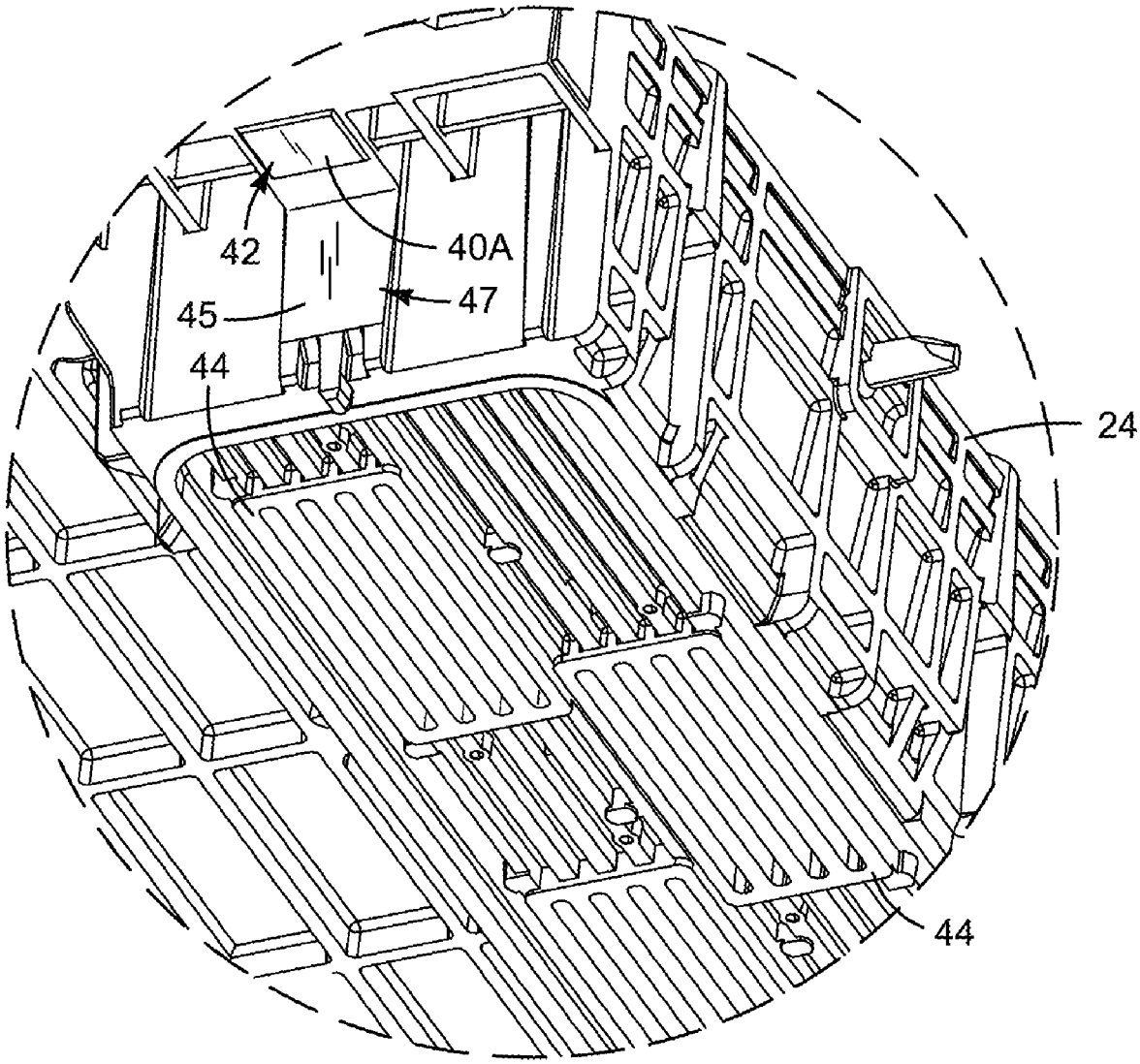
FIG. 15 is a detail perspective of one of the datum reference surfaces and some of the printhead attach surfaces on the print bar body embodiment shown in FIG. 14.

One example embodiment of a print bar 12 will now be described with reference to FIGS. 7-15. FIGS. 7 and 8 are perspectives viewed looking toward the exposed printheads 34, which is typically the bottom of print bar 12 when the print bar 12 is installed in a printer. FIGS. 9 and 10 are perspectives viewed looking into the body of print bar 12, which is typically the top of print bar 12 when print bar 12 is installed in a printer. FIG. 11 is a side elevation view of print bar 12 and FIG. 12 is a partial section view taken along the line 12-12 in FIG. 11. FIGS. 13 and 14 are detail perspectives viewed from the top and bottom, respectively, of the print bar body, and FIG. 15 is a detail perspective of one of the datum reference surfaces and some of the printhead attach surfaces on the print bar body.

Referring to FIGS. 7-15, print bar 12 includes a body 24 supporting a stack 26 of two ink distribution plates—a mid-plate 28 and a manifold 30—within a bay 46 of body 24. As best seen in the section view of FIG. 12, a bottom ink distribution plate 32 is integrated into body 24. In the embodiment shown, as best seen in FIGS. 12-14, body 24 is formed as a single part—a single molded plastic part, for example. Ink flows to the printheads 34 from the ink supplies 20 and flow regulators 16 (FIG. 1) through a series of openings 56 and conduits 58 in plates 28, 30 and 32. A shroud 37 extends along the bottom of print bar 12, covering exposed portions of the bottom surface of body 24 and printheads 34 while leaving the face of each printhead 34 exposed for jetting ink. In the embodiment shown, each printhead 34 is configured as a printhead die assembly 34 that includes a printhead die 60 affixed to a carrier 62. A printhead die assembly such as that shown in FIGS. 7-12 is also commonly referred to as a printhead die carrier assembly.

Three reference surfaces 40A, 40B and 40C form a Z datum 42. As noted above, surfaces 40A, 40B and 40C forming primary Z datum 42 represent three contact points to stop translation of print bar 12 in the Z direction and to stop rotation of print bar 12 about the X and Y axes, when print bar 12 is installed in a printer or when print bar 12 is installed in a fixture for attaching printhead die assemblies 34. Printhead die assemblies 34 are affixed to body 24 at printhead attach surfaces 44 formed along the bottom of body 24. Each attach surface 44 is a predetermined distance Z (FIG. 11) from Z datum reference surfaces 40A and 40B. Although distance Z is the same for each reference surface 40A and 40B in the embodiment of FIGS. 7-15, the Z distance need not be the same for each reference surface 40A and 40B and/or for each attach surface 44. Also, reference 40C might also be used to measure a registration distance Z. In the embodiment shown, datum reference surfaces 40A and 40B and printhead attach surfaces 44 face the same direction. Thus, both features may be formed on the same side of body 24 and, accordingly, both features may be formed in the same part of the mold used to form a monolithic plastic body 24. Thus, this configuration takes advantage of the fact that the feature to feature tolerance in a plastic part is better if both features are formed in the same part of the mold (e.g., the cavity, core, or slide).

As noted above, the example embodiments shown in the Figures and described above do not limit the disclosure. Other forms, details and embodiments may be made without departing from the spirit and scope of the disclosure, which is defined in the following claims.

What is claimed is:

1. A print bar structure, comprising a single part having:
a datum;
an exterior printhead attach surface a predetermined distance from the datum for attaching multiple printheads to the print bar structure;
an interior bay for holding a liquid distribution part; and
multiple openings from the interior bay to the exterior printhead attach surface.

2. The structure of claim 1, wherein the single part is a single molded plastic part.

3. The structure of claim 1, further comprising a liquid distribution part positioned in the bay for distributing liquid to the openings.

4. The structure of claim 3, wherein the liquid distribution part comprises a stack of two or more parts.

5. The structure of claim 1, wherein:
the printhead attach surface comprises multiple printhead attach surfaces each for attaching a printhead to the print bar structure a predetermined distance from the datum; and
one or more of the multiple openings extends from the interior bay to each of the printhead attach surfaces.

6. The structure of claim 1, wherein:
the single part has a length, a width, and a depth;
the datum comprises a first reference surface at one end of the length of the part and a second reference surface at the other end of the length of the part; and
the printhead attach surface comprises a substantially planar surface extending along lengthwise and widthwise axes a predetermined distance from each of the reference surfaces in the depth-wise direction.

7. The structure of claim 6, wherein the reference surfaces and the printhead attach surface face the same direction.

8. The structure of claim 6, wherein the printhead attach surface is the same distance from both reference surfaces in the depth-wise direction.

9. A print bar, comprising:
an elongated body having
a bay extending along an interior face of the body,
a datum,
multiple planar printhead attach surfaces each extending along an exterior face of the body opposite the interior face a predetermined distance from each of the reference surfaces in a direction perpendicular to the exterior face of the body, and
multiple openings from the interior face of the body to the exterior face of the body;
a liquid distribution part affixed to the body in the bay for distributing liquid to the openings; and
multiple printheads each affixed to a corresponding printhead attach surface at a location covering an opening such that liquid may flow from the distribution part through the openings to the printheads.

10. The print bar of claim 9, wherein the elongated body is a single part.

11. The print bar of claim 10, wherein the elongated body is a single molded plastic part.

12. The print bar of claim 9, wherein the liquid distribution part comprises a stack of two or more parts.

13. The print bar of claim 9, wherein:
the datum comprises a first reference surface at one end of the length of the body and a second reference surface at the other end of the length of the body; and
each printhead attach surface extends along the exterior face of the body a predetermined distance from each of the reference surfaces in the direction perpendicular to the exterior face of the body.

14. An inkjet printer, comprising:
an ink supply;
a print bar in fluid communication with the ink supply;
a print media transport for transporting a print media past the print bar; and
a controller operatively connected to the print bar and the media transport; and
the print bar comprising:
a single body part having a datum, an exterior printhead attach surface a predetermined distance from the datum, an interior bay, and multiple openings from the interior bay to the exterior printhead attach surface;
an ink distribution part affixed to the body in the bay for distributing ink to the openings; and
multiple printheads each affixed to the printhead attach surface at a location covering an opening such that ink may flow from the distribution part through the openings to the printheads.

15. The printer of claim 14, wherein the single body part is a single molded plastic part.

* * * * *